US006002242A

United States Patent [19]

Migliavacca

[11] Patent Number: 6,002,242

[45] Date of Patent: Dec. 14, 1999

[54] START-UP AID CIRCUIT FOR A PLURALITY OF CURRENT SOURCES

[75] Inventor: Paolo Migliavacca, Sassenage, France

[73] Assignee: STMicroelectronics, S.A., Gentilly Cedex, France

[21] Appl. No.: 09/128,680

[22] Filed: Aug. 4, 1998

[30] Foreign Application Priority Data

Aug. 28, 1997 [FR] France ..... 97 10755

[51] Int. Cl.[6] ..... G05F 3/04

[52] U.S. Cl. ..... 323/312; 323/314; 323/313; 323/315; 327/543

[58] Field of Search ..... 323/312, 313, 323/314, 315, 316, 901; 327/539, 543, 362

[56] References Cited

U.S. PATENT DOCUMENTS

| | | | |
|---|---|---|---|
| 4,839,535 | 6/1989 | Miller | 327/362 X |
| 4,857,823 | 8/1989 | Bitting | 323/314 |
| 5,180,988 | 1/1993 | McDaniel | 327/543 X |
| 5,448,158 | 9/1995 | Ryat | 323/315 |
| 5,754,039 | 5/1998 | Nishimura | 323/315 |

FOREIGN PATENT DOCUMENTS

| | | | |
|---|---|---|---|
| 0 515 065 A1 | 5/1992 | European Pat. Off. | G05F 3/26 |
| WO 82/04143 | 11/1982 | WIPO | G05F 1/58 |

OTHER PUBLICATIONS

A.L. Fisher et al., "A 50–Mbit/s CMOS Optical Transmitter Intergrated Circuit," IEEE Journal of Solid–State Circuits, vol. SC–21, No. 6, Dec. 1986, pp. 901–908.

"Start–Up Circuit for Bandgap Reference," IBM Technical Disclosure Bulletin, vol. 33, No. 4, Sep. 1990, pp. 264–265.

*Primary Examiner*—Peter S. Wong
*Assistant Examiner*—Rajnikant B. Patel
*Attorney, Agent, or Firm*—Allen, Dyer, Doppelt, Milbrath & Gilchrist, P.A.

[57] ABSTRACT

The start-up aid circuit is connected to a plurality of current sources. The start-up aid circuit is common to all the current sources and supplies a start-up current to each current sources when the current sources are operating in a transient operating state following power-up of the apparatus. The circuit also inhibits the start-up aid circuit when all the current sources have reached an operating state described as stationary. The circuit may be applied to the power supply of microprocessors and electronic equipment.

25 Claims, 2 Drawing Sheets

START-UP AID CIRCUIT FOR A PLURALITY OF CURRENT SOURCES

FIELD OF THE INVENTION

The present invention relates to electronic circuits, and, more particularly, to a start-up aid circuit for a plurality of current sources.

BACKGROUND OF THE INVENTION

Current sources are used in many types of electronic equipment and circuits to provide a constant supply of current. For example, current sources are used to power constant voltage generators, analog circuits, microprocessors, oscillators and analog/digital or digital/analog converters. A complex electronic circuit may be equipped with a plurality of current sources, each intended to power various parts or components of the circuit.

To illustrate the state of the prior art, FIG. 1 attached shows a current source equipped with a known type of starting aid apparatus. The current source is shown as general reference 9 in the diagram of FIG. 1. The current source comprises a first branch 10 connected between a power supply terminal 14 and a ground terminal 16. A first transistor 24 called the mirror transistor is connected in series with a second bipolar npn transistor 26 and a resistor 28 called the emitter resistor. The emitter resistor connects the emitter of bipolar transistor 26*a* to the ground terminal 16.

The first branch 10 is also called the pilot branch of the current source. A second branch 11 of the current source is connected in parallel with first branch 10 between the positive power supply terminal 14 and the ground terminal. The second branch comprises a first transistor 25 called the mirror transistor and a second bipolar npn transistor 27 both connected in series. The bases of bipolar transistors 26 and 27 of the first and second branches are connected to one another and to the collector of transistor 27 of the second branch.

The bipolar transistors of the two branches of the current source have different emitter surfaces. Transistors 26 and 27 thus have a voltage difference between their bases and their emitters. In the diagram of FIG. 1 bipolar transistor 26 of the first branch is considered to have a larger emitter surface than that of bipolar transistor 27 of the second branch. The difference between base-emitter voltages $V_{BE}26$ and $V_{BE}27$ of bipolar transistors 26 and 27 of the first and second branches, 10, 11, respectively, is noted $\delta V_{BE}=V_{BE}26-V_{BE}27$. This voltage difference is relayed to the terminals of the emitter resistor 28 that carries a current $I_{10}$ such that $$I_{10} = \frac{\delta V_{BE}}{R}$$

where R is the value of emitter resistor 28.

As a first approximation it can be considered that current I10, which corresponds to the emitter current of bipolar transistor 26 of the first branch, also corresponds to its collector current. The current $I_{10}$ is, therefore, the current of the first branch 10 of the current source.

Mirror transistors 24 and 25 define a current mirror enabling current $I_{10}$ flowing in the first pilot branch 10 to be copied to the second branch 11. Designating the current of the second branch 11 as $I_{11}$, i.e., more or less the emitter current of transistor 27, it can be verified that $I_{11} \approx I_{10}$.

On power-up of the current source it can operate in two different modes. In the first operating mode it can be verified that $I_{11}=I_{10}=0$ Amp. This operating mode is clearly undesirable since no current is flowing through the current source. In the second operating mode it can be verified that $$I_{10} \equiv I_{11} \frac{\delta V_{BE}}{R}$$

as stated above.

To ensure that the source operates in the second mode, a start-up current is injected into one of the branches immediately after power up of the source. This current creates a slight imbalance between the two branches of the source and avoids the first operating mode where $I_{11}=I_{10}=0$.

In the rest of this description the term "transient operating state" is understood to mean the operating state of the source immediately after power-up, before the current flowing through branches 10 and 11 has reached its nominal value. The start-up current is injected during this transient operating state.

By "stationary operating state" is understood an operating state reached at the end of the transient state during which the current flowing in the branches of the current source reaches its nominal value, i.e., $$\frac{\delta V_{BE}}{R}.$$

In the stationary state the start-up current can and should be interrupted to avoid excessively high consumption of electricity.

Reference 30 of FIG. 1 is a start-up aid circuit for current source 10. The start-up aid circuit also comprises a pilot branch 32 with a first transistor 34. A second transistor 36 that forms a current mirror with first transistor 34 is provided to copy the current in pilot branch 32 of start-up aid circuit to second branch 11 of current source 9.

The first transistor 34 of the pilot branch is connected between power supply terminal 14 and ground terminal 16 in series with the channel of a field-effect transistor 38 called the resistance transistor used here as a high-rating resistor. The gate of this transistor is connected to power supply terminal 14. It should also be noted that the gate of first transistor 34 is connected to its drain.

The gates of first and second transistor 34, 36 of the start-up aid circuit are connected to one another and to power supply terminal 14 (positive) via a transistor 40 called the blocking transistor. The gate of the blocking transistor is connected to the gates of first transistors 10 and 11 of current source 19, again in a mirror-type assembly.

On power-up of the current source and start-up aid circuit, no current initially flows through branches 10 and 11 of the current source. Blocking transistor 40, driven by the current source, is in the closed state in which no current passes through it.

The first transistor 34 of the start-up aid circuit is designed to conduct when blocking transistor 40 is in the closed state. In this state, a current passes through pilot branch 32 and is copied by means of second transistor 36 to current source 9 as the start-up aid current. When the current source reaches the stationary state, a current flows through branches 10 and 11.

Blocking transistor 40, connected as a current mirror with first transistors 24 and 25 of the current source, starts conducting and takes the gates of first and second transistors 34, 36, to more or less the potential $V_{cc}$ of the power supply voltage. First and second transistors 34, 36 of the start-up aid circuit are then in the closed state and the start-up aid current is interrupted.

When first transistor 34 is closed the current flowing in pilot branch 32 is interrupted. However, because blocking transistor 40 is conducting and the gate of first transistor 34 is connected to its drain, a current flows towards and through transistor 38, known as the resistance transistor. This current, which is permanent when the source is in stationary state, contributes to the total electrical consumption of the circuit. To minimize this consumption the resistance of the channel of resistance transistor 38 must be increased.

In one embodiment of the circuit shown in FIG. 1 the channel of resistance transistor 38 is 5 $\mu$m wide and 4,000 $\mu$m long and has a resistance of 20 MΩ. It will be immediately apparent that this type of component is particularly bulky, especially when required for use in the creation of integrated circuit devices.

When an electronic apparatus comprises a plurality of components requiring independent current sources, multiplying start-up aid circuits for these sources is a problem, particularly in integrated versions of the apparatus. This problem is compounded by the large size of the resistance transistor described above. On this subject it has been noted that reducing the size, and, therefore, the resistance of the channel of this transistor is at the cost of an increase in the current consumed. This again is a problem when creating integrated chip apparatuses and devices.

SUMMARY OF THE INVENTION

It is one object of the present invention to provide an electronic apparatus with a plurality of current source and a start-up aid circuit for the current sources that does not have the drawbacks mentioned above.

It is a further object of the invention to provide a start-up aid apparatus for a plurality of sources that is small in size, capable of being constructed in the form of an integrated circuit and has a low electrical consumption.

A further object of the invention is to provide this type of apparatus using a limited number of low-cost components that can be manufactured in series.

More precisely, to achieve these objects, the invention provides an electronic apparatus with a plurality of current sources comprising: a current source start-up aid circuit that is common to all the current sources of the plurality of current sources to supply a start-up circuit to each current source during an operating state described as transient, following power-up of the apparatus. The circuit also includes means for inhibiting the start-up aid circuit when all the current sources of the plurality of current sources have reached a stationary operating state.

Inhibiting the start-up aid circuit is understood as interrupting the start-up current of each source. In accordance with the invention a single start-up aid circuit may be used for all the current sources of the apparatus, while ensuring that each source starts operating correctly. The size of the start-up aid circuit is, therefore, virtually not increased by multiplying the number of current sources. This type of circuit may also be integrated into a chip comprising the electronic apparatus.

According to a feature of the invention, the start-up aid circuit may comprise one branch, called the pilot branch, that conducts a current while the sources are in the transient state, and a plurality of current mirrors corresponding respectively to the plurality of current sources to copy the current of the pilot branch to the plurality of current sources as the start-up current. This characteristic makes it possible for a start-up current to be supplied simultaneously to all the current sources.

According to another advantageous feature, the current mirrors may comprise field-effect transistors and the means for inhibiting the start-up aid circuit may comprise a circuit that blocks the field-effect transistors of the current mirrors. Moreover, the blocking circuit may comprise a plurality of transistors, called blocking transistors, connected in series between the gates of the current mirror transistors and a terminal with a potential that blocks the current mirror transistors.

Each blocking transistor of the plurality of blocking transistors may be respectively driven by a current source of the plurality of current sources, to be set to a conducting state when the current source has reached a stationary operating state. It should be noted that the blocking transistors are designed and biased so that they are in the closed state when the corresponding current sources are in the transient state. It is therefore possible, using a limited number of components, to ensure that each current source reaches its stationary operating state before the start-up aid circuit is inhibited. The blocking transistors are connected to their respective current sources, for example, in a current mirror type setup.

The invention has as another object a start-up aid apparatus comprising a start-up aid circuit and means for inhibiting the circuit such as those described above.

BRIEF DESCRIPTION OF THE DRAWINGS

Other characteristics and advantages of the present invention will be better understood from the following description that refers to the attached Figures. The description, which refers particularly to an apparatus with two current sources, is given as a non-limitative example.

DETAILED DESCRIPTION OF THE PREFERRED EMBODIMENTS

Figure 1:
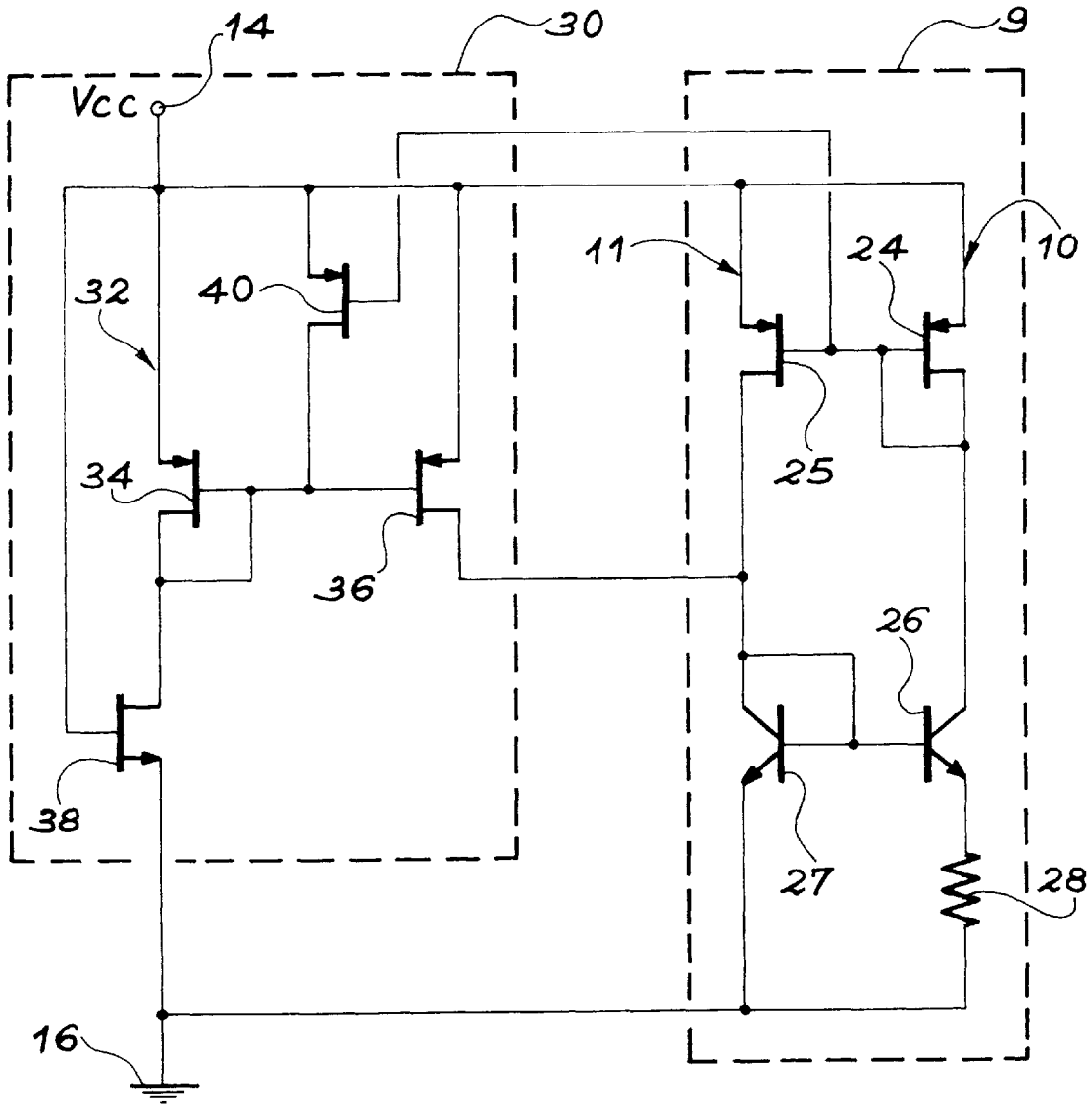
FIG. 1 is an electrical diagram of a current source fitted with a start-up aid circuit according to the prior art.
Figure 2:
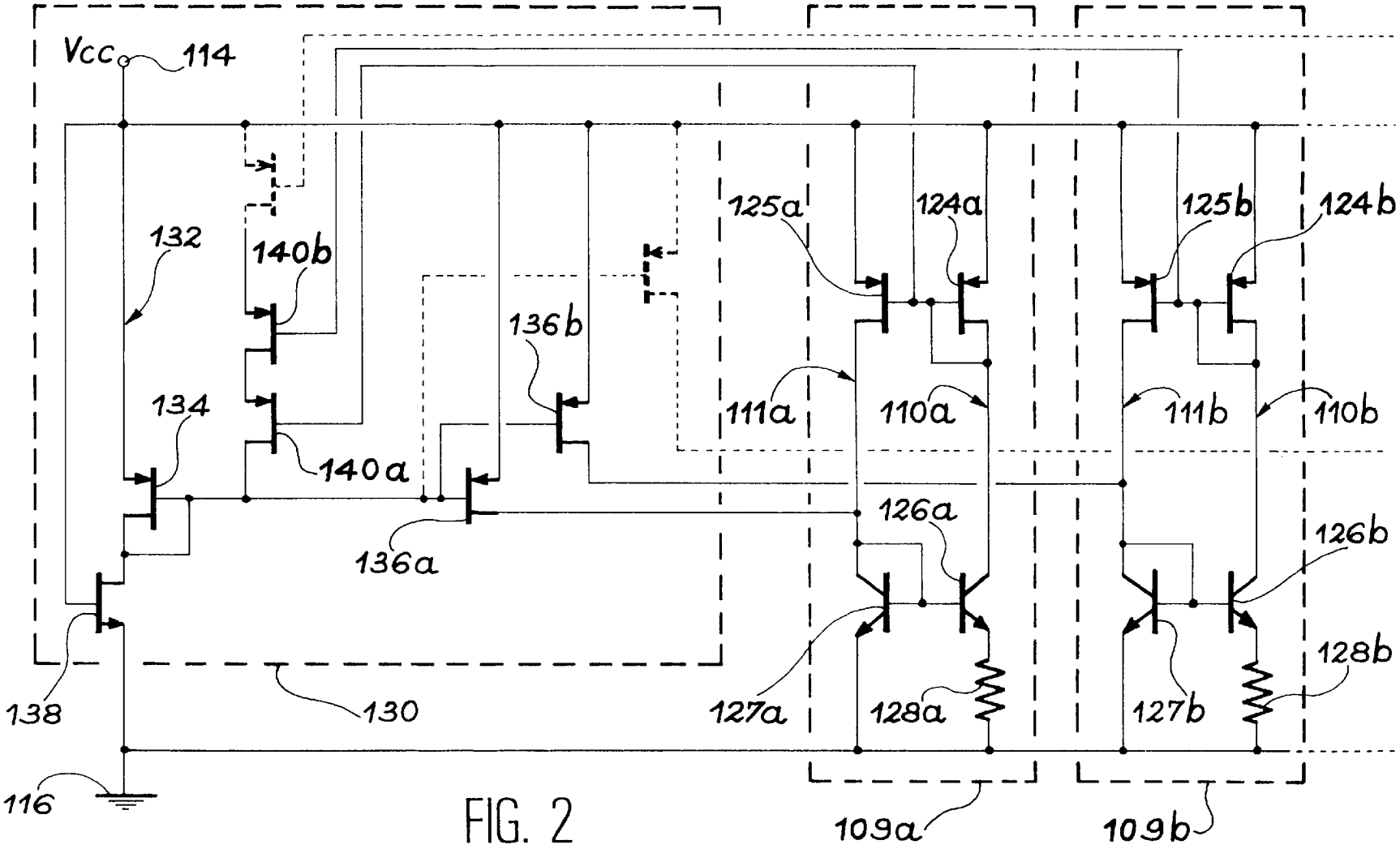
FIG. 2 is an electrical diagram of a start-up aid apparatus according to the invention, used for a plurality of sources.

To simplify the description, components in FIG. 2 that are identical, similar or equivalent to those already described in FIG. 1 have the same reference numbers plus 100. Also in FIG. 2, two current sources 109*a* and 109*b* are shown. Identical or similar components related to these current sources have the same references, but are distinguished from one another by the letters a and b following the reference number.

Each source has two branches 110*a*, 111*a*, 110*b*, 111*b*. A first branch 110*a*, 110*b* of each current source comprises, between a power supply terminal 114 and a ground terminal 116, a first mirror transistor 124*a*, 124*b* in series with a second, bipolar transistor 126*a*, 126*b* and an emitter resistor 128*a*, 128*b* connecting the emitter of the bipolar transistor to the ground terminal. A second branch 111*a*, 111*b* of each source comprises in series, between the positive power supply terminal 114 and the ground terminal 116, a first mirror transistor 125*a*, 125*b* and a second bipolar transistor 127*a*, 127*b* whose emitter is directly connected to ground terminal 116.

The gates of the mirror transistors of the first and second branches of the current sources are connected to one another in a current mirror type setup. Similarly, the bases of the bipolar transistors of the first and second branches are connected to one another. Lastly, in each current source the gate of the first transistor 124*a*, 124*b* of the first branch of each current source is connected to its drain and the collector of bipolar transistor 127*a*, 127*b* of the second branch is connected to its base. The operation of a source such as that of sources 109*a* and 109*b* of FIG. 2 was explained above with reference to FIG. 1 and is not repeated here.

It will be noted that other current sources, not shown but identical to 109*a* and 109*b*, may be added to the apparatus. These sources are connected in parallel to sources 109*a* and 109*b* between the positive power supply terminal 114 and the ground terminal 116.

Reference 130 is a start-up aid circuit for the current sources. It comprises a pilot branch 132 comprising in series, between the power supply terminal 114 and the ground terminal 116, a first transistor 134 and the channel of a transistor 138, called the resistance transistor. The channel of this transistor is designed to have a high electrical resistance on the order of 20 MΩ.

The gate of first transistor 134 of the pilot branch is connected to the gates of second transistors 136*a*, 136*b* that form current mirrors with the first transistor 134. The sources of the second transistors are connected to power supply terminal 114, at potential Vcc and their drains connected to the second branches 111*a*, 111*b* of current sources 109*a*, 109*b* respectively, or more precisely to the collectors of bipolar transistors 127*a*, 127*b*.

The first transistor 134 is designed to be in a conducting state on power-up of the apparatus. A current flows through the pilot branch 132 of the start-up aid circuit immediately on power-up of the apparatus. This current in the pilot branch 132 is copied to each current source 109*a*, 109*b* respectively by means of second transistors 136*a*, 136*b*. These transistors thereby supply the start-up current necessary for each current source.

The gate of the first transistor 134, together with the gates of second transistors 136*a*, 136*b* are also connected to the power supply terminal 114 via transistors 140*a*, 140*b* whose channels are connected in series. These transistors are referred to here as "blocking transistors". The gates of the blocking transistors are connected to the gates of first mirror transistors 124*a*, 124*b*, 125*a*, 125*b* of current sources 109*a*, 109*b*.

When the first current source 109*a* reaches the stationary operating state and a current is flowing through it, the corresponding blocking transistor 140*a* starts conducting. Similarly, when the second current source 109*b* comes into operation, the corresponding blocking transistor 140*b* starts conducting.

Therefore, when all the sources are in operation the gates of the first and second transistors of the start-up aid circuit are taken to more or less the potential $V_{cc}$ of the power supply, which provides a blocking potential, and ceases conducting. The start-up current of all the current sources is then interrupted.

As already stated, more than two current sources may be connected to the start-up aid circuit. As an example, in FIG. 2 transistors intended for current sources not shown in the diagram are shown as unbroken lines. It will be seen that increasing the number of sources connected to the start-up aid circuit only slightly increases the number of components required to build the circuit. In particular, only one transistor 138, called the resistance transistor, which is particularly cumbersome due to the length of its channel, is required.

When the start-up aid apparatus is integrated on a chip, the resistance transistor channel may be advantageously constructed in a border surrounding the chip to take up the minimum amount of space.

That which is claimed is:

1. An electronic apparatus comprising:

a plurality of current sources, each current source having a transient operating state following power-up of the apparatus and a stationary operating state after the transient state;

a start-up aid circuit for said current sources that is common to the current sources of said plurality of current sources to provide a start-up current to each current source while the current sources are in the transient operating state; and means for inhibiting the start-up aid circuit when all the current sources of said plurality of current sources have reached the stationary operating state.

2. An electronic apparatus according to claim 1 wherein said start-up aid circuit comprises:

a pilot branch that conducts a current while the current sources are in the transient operating state; and a plurality of current mirrors corresponding respectively to said plurality of current sources to copy a current of the pilot branch to the plurality of current sources as a start-up current therefor.

3. An electronic apparatus according to claim 2 wherein said pilot branch comprises an electrical resistor and a first transistor connected in series with each other and connected between a power supply terminal and a ground terminal.

4. An electronic apparatus according to claim 3 wherein the electrical resistor comprises a field-effect transistor channel.

5. An electronic apparatus according to claim 2 wherein the current mirrors comprise field-effect transistors; and wherein the said means for inhibiting comprises a circuit that blocks the field-effect transistors of the current mirrors.

6. An electronic apparatus comprising:

a plurality of current sources, each current source having a transient operating state following power-up of the apparatus and a stationary operating state after the transient state;

a start-up aid circuit operatively connected to said current sources to provide a start-up current to each current source while the current sources are in the transient operating state, said start-up circuit including a pilot branch circuit that conducts a current while the current sources are in the transient operating state and a plurality of current mirrors formed as field-effect transistors having gates and corresponding respectively to the plurality of current sources to copy a current of the pilot branch to the plurality of current sources as a start-up current therefor; and a blocking circuit for inhibiting the start-up aid circuit when all the current sources of said plurality of current sources have reached the stationary operating state, wherein said blocking circuit comprises a plurality of blocking transistors connected in series between gates of the field-effect transistors and a terminal with a blocking potential.

7. An electronic apparatus according to claim 6 wherein each blocking transistor is respectively driven by a current source of the plurality of current sources, to be set to conducting state when the current source has reached the stationary operating state.

8. An electronic apparatus according to claim 7 wherein each blocking transistor is connected to a respective current source in a current mirror arrangement.

9. An electronic apparatus comprising:

a plurality of current sources, each current source having a transient operating state following power-up of the apparatus and a stationary operating state after the transient state;

a common start-up aid circuit for said plurality of current sources to provide a start-up current to each current source while the current sources are in the transient operating state, said start-up aid circuit comprising a pilot branch that conducts a current while the current sources are in the transient operating state, and a plurality of current mirrors corresponding respectively to said plurality of current sources to copy a current of the pilot branch to the plurality of current sources as a start-up current therefor; and a blocking circuit for inhibiting the start-up aid circuit when all the current sources of said plurality of current sources have reached the stationary operating state.

10. An electronic apparatus according to claim 9 wherein the current mirrors comprise field-effect transistors; and wherein the said blocking circuit blocks the field-effect transistors of the current mirrors.

11. An electronic apparatus according to claim 9 wherein said pilot branch comprises an electrical resistor and a first transistor connected in series with each other and connected between a power supply terminal and a ground terminal.

12. An electronic apparatus according to claim 11 wherein the electrical resistor comprises a field-effect transistor channel.

13. An electronic apparatus comprising:

a plurality of current sources, each current source having a transient operating state following power-up of the apparatus and a stationary operating state after the transient state;

a common start-up aid circuit for said plurality of current sources to provide a start-up current to each current source while the current sources are in the transient operating state, said start-up circuit including a pilot branch circuit that conducts a current while the current sources are in the transient operating state and a plurality of current mirrors formed as field-effect transistors having gates and corresponding respectively to the plurality of current sources to copy a current of the pilot branch to the plurality of current sources as a start-up current therefor; and a blocking circuit for inhibiting the start-up aid circuit when all the current sources of said plurality of current sources have reached the stationary operating state, wherein said blocking circuit comprises a plurality of blocking transistors connected in series between gates of the field-effect transistors and a terminal with a blocking potential.

14. An electronic apparatus according to claim 13 wherein each blocking transistor is respectively driven by a current source of the plurality of current sources, to be set to conducting state when the current source has reached the stationary operating state.

15. An electronic apparatus according to claim 13 wherein each blocking transistor is connected to a respective current source in a current mirror arrangement.

16. A control circuit for an electronic apparatus comprising a plurality of current sources, each current source having a transient operating state following power-up of the apparatus and a stationary operating state after the transient state, the control circuit comprising:

a start-up aid circuit for the current sources that is common to the current sources of the plurality of current sources to provide a start-up current to each current source while the current sources are in the transient operating state; and means for inhibiting the start-up aid circuit when all the current sources of the plurality of current sources have reached the stationary operating state.

17. A control circuit according to claim 16 wherein said start-up aid circuit comprises:

a pilot branch that conducts a current while the current sources are in the transient operating state; and a plurality of current mirrors corresponding respectively to the plurality of current sources to copy a current of the pilot branch to the plurality of current sources as a start-up current therefor.

18. A control circuit according to claim 17 wherein said pilot branch comprises an electrical resistor and a first transistor connected in series with each other and connected between a power supply terminal and a ground terminal.

19. A control circuit according to claim 18 wherein the electrical resistor comprises a field-effect transistor channel.

20. A control circuit according to claim 17 wherein the current mirrors comprise field-effect transistors; and wherein the said means for inhibiting comprises a circuit that blocks the field-effect transistors of the current mirrors.

21. A control circuit comprising:

a plurality of current sources, each current source having a transient operating state following power-up of the apparatus and a stationary operating state after the transient state;

a start-up aid circuit for said current sources that is common to said plurality of current sources to provide a start-up current to each current source while the current sources are in the transient operating state, said start-up circuit includes a pilot branch circuit that conducts a current while the current sources are in the transient operating state and a plurality of current mirrors formed as field-effect transistors having gates and corresponding respectively to the plurality of current sources to copy a current of the pilot branch to the plurality of current sources as a start-up current therefor; and a blocking circuit for inhibiting the start-up aid circuit when all the current sources of said plurality of current sources have reached the stationary operating state, wherein said blocking circuit comprises a plurality of blocking transistors connected in series between gates of the field-effect transistors and a terminal with a blocking potential.

22. A control circuit according to claim 21 wherein each blocking transistor is respectively driven by a current source of the plurality of current sources, to be set to conducting state when the current source has reached the stationary operating state.

23. A control circuit according to claim 22 wherein each blocking transistor is connected to a respective current source in a current mirror arrangement.

24. A method for controlling an electronic apparatus comprising a plurality of current sources, each current source having a transient operating state following power-up of the apparatus and a stationary operating state after the transient state, the method comprising the steps of:

using a start-up aid circuit for the current sources that is common to the current sources of the plurality of current sources to provide a start-up current to each current source while the current sources are in the transient operating state; and inhibiting the start-up aid circuit when all the current sources of the plurality of current sources have reached the stationary operating state.

25. A method according to claim 24 wherein the start-up aid circuit comprises a pilot branch that conducts a current while the current sources are in the transient operating state, and a plurality of current mirrors corresponding respectively to the plurality of current sources to copy a current of the pilot branch to the plurality of current sources as a start-up current therefor; and wherein the step of inhibiting comprises blocking the current mirrors.

* * * * *